United States Patent [19]

Zysset et al.

[11] Patent Number: 4,804,105

[45] Date of Patent: Feb. 14, 1989

[54] METHOD FOR FABRICATING BURR-FREE PULL TABS AND ARTICLES

[75] Inventors: Edgar H. Zysset, St. Cloud; Raymond A. Atkinson, Orlando, both of Fla.

[73] Assignee: Citrus Central, Inc., Orlando, Fla.

[21] Appl. No.: 179,998

[22] Filed: Apr. 11, 1988

[51] Int. Cl.[4] ..... B65D 17/34

[52] U.S. Cl. ..... 220/273; 413/14

[58] Field of Search ..... 220/269, 270, 273; 413/12, 14

[56] References Cited

U.S. PATENT DOCUMENTS

| | | | |
|---|---|---|---|
| 4,042,144 | 8/1977 | Henning et al. | 220/273 |
| 4,524,879 | 6/1985 | Fundom et al. | 220/273 |
| 4,535,909 | 8/1985 | Zysset | 220/273 |
| 4,596,342 | 6/1986 | Zysset | 220/273 |

*Primary Examiner*—George T. Hall

*Attorney, Agent, or Firm*—Duckworth, Allen, Dyer & Doppelt

[57] ABSTRACT

Pull tabs for easy open containers are fabricated so as to avoid the presence of burrs after severing the carrier lugs, by removing each tab from the carrier sheet by severing each lug and a portion of the tab next adjacent the lug extremity, so that the burrs are avoided. Each radius has a dimension along the periphery of the tab which is slightly greater than the width of the severed lug, and with each radius located along a portion of the periphery of the tab which remains uncurled during the fabrication process.

9 Claims, 1 Drawing Sheet

METHOD FOR FABRICATING BURR-FREE PULL TABS AND ARTICLES

BACKGROUND OF THE INVENTION

1. Field of the Invention

The present invention relates generally to easy open containers, and specifically to methods for fabricating metal pull tabs for such easy open containers.

2. Description of the Prior Art

Containers with "easy open" pull tabs have become a convenience of every day American life. As a consequence, there is a huge demand for such containers, and the manufacturer of the metal pull tabs are only susceptible to high speed manufacturing techniques.

Typically, the metal pull tabs are fabricated using high speed metal stamping techniques from long strips of metal carrier sheets, with each pull tab being held to the carrier sheet by thin metal strips, or "lugs", which maintain the integrity of the metal sheet until each pull tab has undergone all of the metal forming steps. Thereafter, the lugs are severed to remove each pull tab from the carrier sheet.

As is described more fully below with respect to FIGS. 1 and 2, it is also customary to curl the periphery of the pull tab, so as to prevent sharp metal edges from being presented to the fingers of the end user of the container. Thus, the lugs are typically located forwardly of the pull tab during fabrication, at a point along the periphery of the pull tab is not curled. In the past, when the lugs are positioned along the uncurled forward peripheral portion of the pull tab, the severing of the lug often results in burrs along that forward periphery. After the pull tab is affixed to a container end, these burrs frequently score the lacquer finish on the container end, exposing the end to possible oxidation contamination.

SUMMARY OF THE INVENTION

It is the purpose of the method of the present invention to fabricate easy open pull tabs in such a way as to avoid the presence of burrs after severing the carrier lugs during the manufacturing operation. To this end, the metal pull tabs are fabricated by removing each tab from the carrier sheet by severing each lug and a portion of the tab next adjacent the lug extremity, so that metal burrs are avoided.

More specifically, the severing step comprises the formation of an inwardly curving radius in the tab at the lug extremity, the radius having a dimension along the periphery of the tab which is slightly greater than the width of the severed lug, with each radius located along a portion of the periphery of the tab which remains uncurled during the fabrication process. Preferably, the uncurled portion is adjacent to the nose of the pull tab, and may include a radius along each side of the nose.

DESCRIPTION OF THE PRIOR ART

Figure 1:
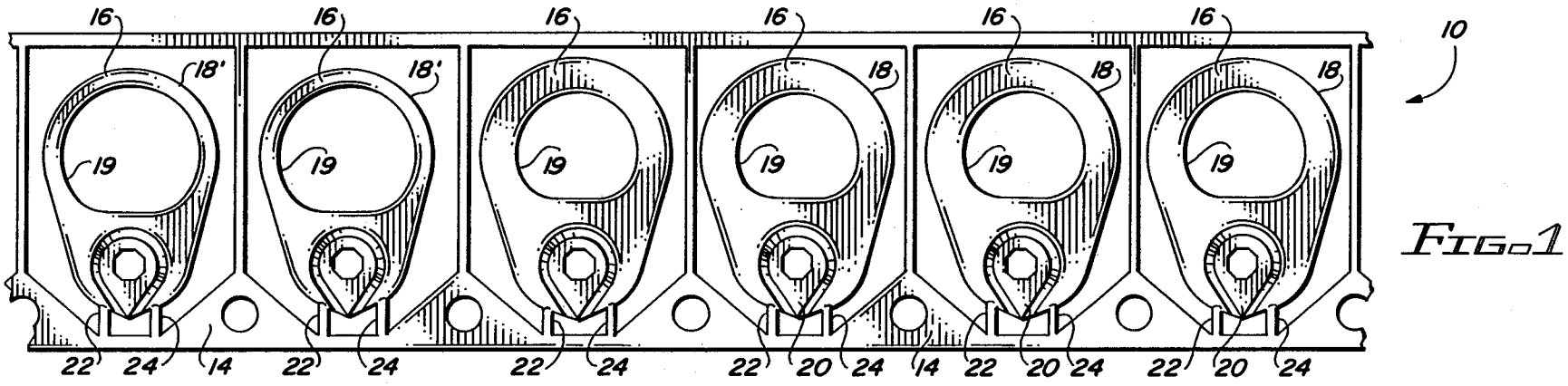
FIG. 1 is a top plan view of a carrier sheet for fabricating easy open pull tabs, illustrating conventional fabrication techniques for easy open pull tabs.

A portion of the fabrication techniques conventionally used in manufacturing easy open pull tabs will be described with reference to FIG. 1. As there shown, a carrier sheet or strip 10 includes a pair of rails 12, 14 from which has been stamped a plurality of pull tabs 16. Some of the pull tabs on the right hand side of FIG. 1 have a periphery 18 which has not yet been curled; the pull tabs 16 on the left side of FIG. 1 have a portion of the periphery 18' which is curled.

Each of the pull tabs 16 remains connected to the carrier strip 10 via a pair of lugs 22, 24 which are positioned on opposite sides of the nose 20. Each pull tab 16 remains connected to the carrier strip 10 via the lugs 22, 24 until all of the fabricating steps have been completed; afterwards, the lugs 22, 24 are severed along the portion of the periphery 18 which remains uncurled (i.e., along the forward portion of the pull tab 16).

Each pull tab is typically provided with a center hole 19.

Figure 2:
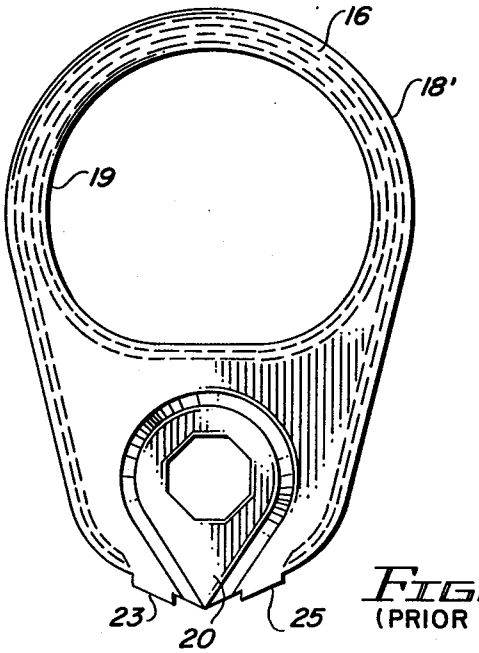
FIG. 2 (PRIOR ART)
FIG. 2 is a top plan view illustrating a prior art pull tab having burrs along the uncurled periphery adjacent the nose.

Reference is now made to FIG. 2, which illustrates a prior art pull tab, in which the lugs 22, 24 have been removed by conventional techniques, in which a cut-off mechanism is used to slice the lugs at the extremities thereof adjacent the uncurled portion of the periphery of the pull tab 16. Conventional cut-off mechanisms typically leave burrs, such as burrs 23 and 25 in FIG. 2, along the uncurled peripheral portion of the pull tab 16, on opposite sides of the nose 20.

Figure 3:
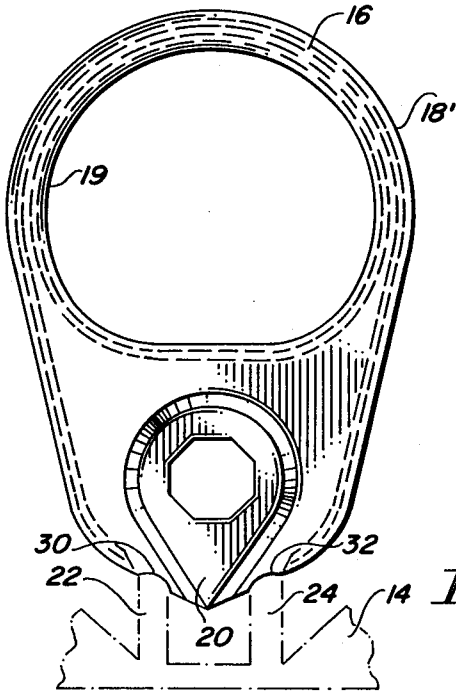
FIG. 3 is a top plan view of a pull tab illustrating the method and article of the present invention.

The method of the present invention for avoiding the difficulties associated with the burrs 23 and 25 along the uncurled peripheral portion of the tab 16 will now be described with reference to FIG. 3. As shown there, the lugs 22 and 24 (shown by imaginary lines) are severed from the uncurled peripheral portion of the tab 16 by using a cutting mechanism which creates a slight inwardly curving radius 30, 32, so as to remove a small portion of the periphery of the pull tab 16 on opposite sides of the nose 20, but which removed portions are only along the uncurled portion of the periphery 18' of the pull tab 16. Preferably (and as is shown in FIG. 3), each removed radius 30,32 has a dimension along the perimeter of the tab 16 which is slightly greater than the width of the distal extremity of the corresponding lug 22, 24. It is also preferred that the uncurled portion be along opposite sides of the nose 20, so that the remaining portion of the periphery 18' of the tab 16 can be curled, so as to avoid presenting a sharp edge to the fingers of the end user.

It will thus be understood that the method and article of the present invention avoids the difficulties associated with the burrs along the uncurled periphery of an easy open tab.

What is claimed is:

1. A method for fabricating metal pull tabs for containers, comprising the steps of:

forming plural pull tabs in a metal sheet with each tab attached to said sheet with one or more lugs; and removing each tab from said sheet by severing each lug and a portion of said tab next adjacent the lug extremity, whereby metal burrs are avoided.

2. The method recited in claim 1 wherein said tab and said lugs are of a uniform fitness.

3. The method recited in claim 1 wherein said lug and tab portion severing step comprises the step of forming a radius in said tab periphery at the lug extremity.

4. The method recited in claim 3 wherein said radius has a dimension along the periphery of said tab which is slightly greater than the width of said lug.

5. The method recited in claim 1 further comprising the steps of curling a portion of the periphery of each tab, and wherein said lug and tab portion are positioned along a portion of the tab periphery which remains uncurled.

6. The method recited in claim 5 wherein said tab comprises a nose adapted for use in opening a container to which said tab is attached, said uncurled portion extending about said nose.

7. The method recited in claim 6 further comprising the step of removing two lug and tab portions, each alongside said nose.

8. A pull tab made by the method recited in claim 1.

9. A pull tab for containers which has been severed from a metal sheet, comprising:

a flat metal panel having a curled peripheral portion and an uncurled peripheral portion;

a protruding nose along said uncurled peripheral portion and adapted for facilitating the opening of the container to which said pull tab is attached; and inwardly-extending radii along said uncurled periphery portion on either side of said protruding nose, said radii avoiding metal burrs which might otherwise extend outwardly from said uncurled periphery portion.

* * * * *